US011110318B2

(12) United States Patent
Lo

(10) Patent No.: US 11,110,318 B2
(45) Date of Patent: Sep. 7, 2021

(54) LINKAGE MECHANISM WITH ELLIPTICAL MOTION TRAJECTORY

(71) Applicant: HEALTHSTREAM TAIWAN INC., Taoyuan (TW)

(72) Inventor: Yi-Chung Lo, Taoyuan (TW)

(73) Assignee: HEALTHSTREAM TAIWAN INC., Taoyuan (TW)

( * ) Notice: Subject to any disclaimer, the term of this patent is extended or adjusted under 35 U.S.C. 154(b) by 42 days.

(21) Appl. No.: 16/726,663

(22) Filed: Dec. 24, 2019

(65) Prior Publication Data

US 2021/0178222 A1 Jun. 17, 2021

(30) Foreign Application Priority Data

Dec. 17, 2019 (TW) ..... 108146295

(51) Int. Cl.

| | |
|---|---|
| ***A63B 21/22*** | (2006.01) |
| ***A63B 22/06*** | (2006.01) |
| ***A63B 22/20*** | (2006.01) |
| *A63B 23/04* | (2006.01) |

(52) U.S. Cl.

CPC ..... *A63B 22/0664* (2013.01); *A63B 21/225* (2013.01); *A63B 22/201* (2013.01); *A63B 22/205* (2013.01); *A63B 22/0694* (2013.01); *A63B 23/0423* (2013.01); *A63B 2022/0682* (2013.01)

(58) Field of Classification Search

None

See application file for complete search history.

(56) References Cited

U.S. PATENT DOCUMENTS

| | | | | |
|---|---|---|---|---|
| 5,766,113 | A * | 6/1998 | Rodgers, Jr. | A63B 22/001 482/52 |
| 5,957,814 | A * | 9/1999 | Eschenbach | A63B 22/0664 482/51 |
| 6,024,676 | A * | 2/2000 | Eschenbach | A63B 22/001 482/51 |
| 6,168,552 | B1 * | 1/2001 | Eschenbach | A63B 22/001 482/51 |
| 6,422,977 | B1 * | 7/2002 | Eschenbach | A63B 22/001 482/51 |
| 6,454,682 | B1 * | 9/2002 | Kuo | A63B 22/001 482/52 |
| 6,758,790 | B1 * | 7/2004 | Ellis | A63B 22/001 482/52 |
| 7,022,049 | B2 * | 4/2006 | Ryan | A63B 22/001 482/51 |

(Continued)

*Primary Examiner* — Sundhara M Ganesan

*Assistant Examiner* — Shila Jalalzadeh Abyaneh

(74) *Attorney, Agent, or Firm* — Muncy, Geissler, Olds & Lowe, P.C.

(57) ABSTRACT

A linkage mechanism with an elliptical motion trajectory includes a main body having two guiding tracks with a changeable lifting angle, a flywheel assembly and two handles installed on a front side of the main body, a first linkage rod pivotally attached between guiding rods of two driving linkage assemblies and two cranks of the flywheel assembly. The two pedals respectively include a front end pivotally attached onto each one of the cranks. Each one of the pedals moves together each one of the guiding rods and along each one of the guiding tracks and drives the flywheel assembly and each one of the handles to move forward and backward.

6 Claims, 3 Drawing Sheets

(56) References Cited

U.S. PATENT DOCUMENTS 7,037,242 B2 * 5/2006 Lo ..... A63B 22/001 482/52
7,175,568 B2 * 2/2007 Eschenbach ..... A63B 22/001 482/52
7,223,209 B2 * 5/2007 Lee ..... A63B 22/001 482/52
7,316,633 B2 * 1/2008 Liao ..... A63B 22/001 482/52
7,377,879 B1 * 5/2008 Chen ..... A63B 22/001 482/51
7,455,624 B2 * 11/2008 Liao Lai ..... A63B 22/001 482/51
7,462,135 B2 * 12/2008 Lo ..... A63B 22/001 482/52
7,591,761 B1 * 9/2009 Ellis ..... A63B 21/22 482/52
7,618,350 B2 * 11/2009 Dalebout ..... A63B 22/001 482/52
D606,599 S * 12/2009 Murray ..... D21/668
7,674,205 B2 * 3/2010 Dalebout ..... A63B 21/02 482/52
7,727,120 B2 * 6/2010 Smith ..... A63B 22/0007 482/52
7,749,137 B2 * 7/2010 Watt ..... A63B 24/00 482/52
7,785,235 B2 * 8/2010 Lull ..... A63B 22/0017 482/52
7,854,691 B2 * 12/2010 Long ..... A63B 22/0664 482/57
8,051,752 B2 * 11/2011 Murray ..... A63B 21/225 82/52
8,376,913 B2 * 2/2013 Lee ..... A63B 22/0664 482/52
8,628,454 B2 * 1/2014 Wu ..... A63B 22/203 482/52
8,840,529 B2 * 9/2014 Chen ..... A63B 22/0015 482/52
9,050,485 B2 * 6/2015 Huang ..... A63B 22/203
9,067,101 B1 * 6/2015 Chuang ..... A63B 22/0664
9,108,081 B2 * 8/2015 Giannelli ..... A63B 22/201
9,186,541 B1 * 11/2015 Murray ..... A63B 22/201
9,259,610 B2 * 2/2016 Huang ..... A63B 21/225
9,808,667 B2 * 11/2017 Liao ..... A63B 22/0664
9,849,332 B1 * 12/2017 Huang ..... A63B 22/0664
9,931,534 B2 * 4/2018 Huang ..... A63B 23/03516
D843,503 S * 3/2019 Xing ..... D21/670
10,343,013 B2 * 7/2019 Xing ..... A63B 21/0088
10,471,300 B2 * 11/2019 Chen ..... A63B 22/0664
10,543,396 B2 * 1/2020 Yim ..... A63B 24/0087
2004/0053748 A1 * 3/2004 Lo ..... A63B 22/0007 482/52
2006/0003868 A1 * 1/2006 Lull ..... A63B 22/001 482/52
2006/0166791 A1 * 7/2006 Liao ..... A63B 22/001 482/52
2006/0199702 A1 * 9/2006 Eschenbach ..... A63B 22/001 482/52
2006/0223678 A1 * 10/2006 MacLean ..... A63B 22/001 482/51
2007/0042871 A1 * 2/2007 Wu ..... A63B 22/0664 482/52
2007/0087907 A1 * 4/2007 Rodgers, Jr. ..... A63B 22/0017 482/52
2007/0161464 A1 * 7/2007 Chiles ..... A63B 22/0664 482/52
2008/0032868 A1 * 2/2008 Pan ..... A63B 22/001 482/52
2011/0039661 A1 * 2/2011 Long ..... A63B 21/225 482/52
2011/0172062 A1 * 7/2011 Miller ..... A63B 22/0664 482/52
2011/0294627 A1 * 12/2011 Lai ..... A63B 22/0664 482/70
2013/0210585 A1 * 8/2013 Arnold ..... A63B 21/0052 482/52
2013/0310225 A1 * 11/2013 Johnson ..... A63B 22/203 482/52
2014/0194254 A1 * 7/2014 Huang ..... A63B 22/04 482/52
2015/0087481 A1 * 3/2015 Liu ..... A63B 22/0664 482/52
2016/0213970 A1 * 7/2016 Eschenbach ..... A63B 22/0015
2017/0036062 A1 * 2/2017 Huang ..... A63B 22/0056
2017/0157460 A1 * 6/2017 Lin ..... A63B 22/0017
2018/0339189 A1 * 11/2018 Luger ..... A63B 71/0619
2020/0376325 A1 * 12/2020 Yu ..... A63B 22/0664

* cited by examiner

LINKAGE MECHANISM WITH ELLIPTICAL MOTION TRAJECTORY

BACKGROUND OF THE INVENTION

1. Technical Field

The present invention relates to a linkage mechanism of a fitness equipment, in particular, to a linkage mechanism with an elliptical motion trajectory.

2. Description of Related Art

Since the use of an elliptical trainer for workout and exercise has the characteristics of simulating natural walking posture and achieving exercise outcome, the elliptical motion trajectory formed by the repetitive stepping actions of both feet of the exercising person is able to drive the linkage bars and the flywheels to move such that it is able to achieve the full-body workout with aerobic exercise effect while preventing knee joint injuries. Consequently, elliptical trainers are widely recommended and used by sports enthusiasts.

Presently, there are a variety of elliptical trainers in the market. The questions on how to allow exercising person to perform the stepping action with greater comfort, to provide greater stability during the stepping process and to achieve ergonomics and operating comfort etc. are important subjects to the design of an elliptical trainer.

BRIEF SUMMARY OF THE INVENTION

Accordingly, the primary objective of the present invention is to provide a linkage mechanism with an elliptical motion trajectory such that it is able to provide a relatively more stable elliptical motion trajectory, to allow the stepping action of exercising person to be more stable as well as to achieve ergonomics and to provide operating comfort for exercise.

To achieve the foregoing objective, the present invention provides a linkage mechanism with an elliptical motion trajectory, comprising a main body, a flywheel assembly, two handles, two driving linkage assemblies and two pedals. The main body includes two guiding tracks with a changeable lifting angle. The flywheel assembly includes two cranks and the flywheel is installed on a front side of the main body. The two handles are pivotally attached onto the front side of the main body corresponding to each other. Each one of the driving linkage assembly includes a guiding rod. A first linkage rod is pivotally attached between one end of each one of the guiding rods and each one of the cranks. A guiding wheel is installed on another end of each one of the guiding rods and rollably arranged on each one of the guiding tracks. Each one of the pedals includes a front end pivotally attached onto each one of the cranks. Each one of the pedals includes a stepping portion installed on each one of the guiding rods at a location adjacent to each one of the guiding wheels. A second linkage rod is pivotally attached between each one of the pedals and a bottom end of each one of the handles. Each one of the pedals is configured to move together with each one of the guiding rods and along each one of the guiding tracks, and is configured to drive the flywheel assembly and each one of the handles to move forward and backward.

Preferably, wherein the flywheel assembly comprises at least two flywheel disks of different weights and a transmission belt arranged to surround between the at least two flywheel disks.

Preferably, wherein each one of the cranks comprises a first crank member and a second crank member, a spacing rod installed between the first crank member and a second crank member the front end of each one of the pedals is pivotally attached onto each one of the spacing rods.

Preferably, wherein each one of the first linkage rods is pivotally attached between one end of each one of the guiding rods and the second crank member.

Preferably, wherein the main body includes a driving motor, and the two guiding tracks are driven by the driving motor to change the lifting angle relative to the main body.

Regarding the detailed structure or technical features of the present invention, details are provide in the following accompanied drawings and description. However, a person with ordinary skill in the art in the technical field of the present invention shall understand that such detailed description and the specific embodiments disclosed in the present invention are provided to illustrate the present invention only such that they shall not be treated as limitation of the scope of the claim of the present invention.

DETAILED DESCRIPTION OF THE INVENTION

The following provides preferred embodiments along with the accompanied drawings to describe the technical content and features of the present invention in detail. A person skilled in the art in this field is able to understand that the description and terms used to describe the embodiments refer to the superordinate descriptions not limited to the application field. For example, the terms of materials or shapes used include but not limited to the specified materials or shapes only. The terms of location positioning include but not limited to being arranged at, adjacent to, connected to or abutted to. The terms of quantity of each element such as "one" includes the quantity of one and more than one of plurality of elements. The directional terms of "up", "down", "inner", "outer", "top" and "bottom" etc. are descriptive terms as examples for normal direction of use, which shall not be treated as limitations to the scope of the claim.

Figure 1:
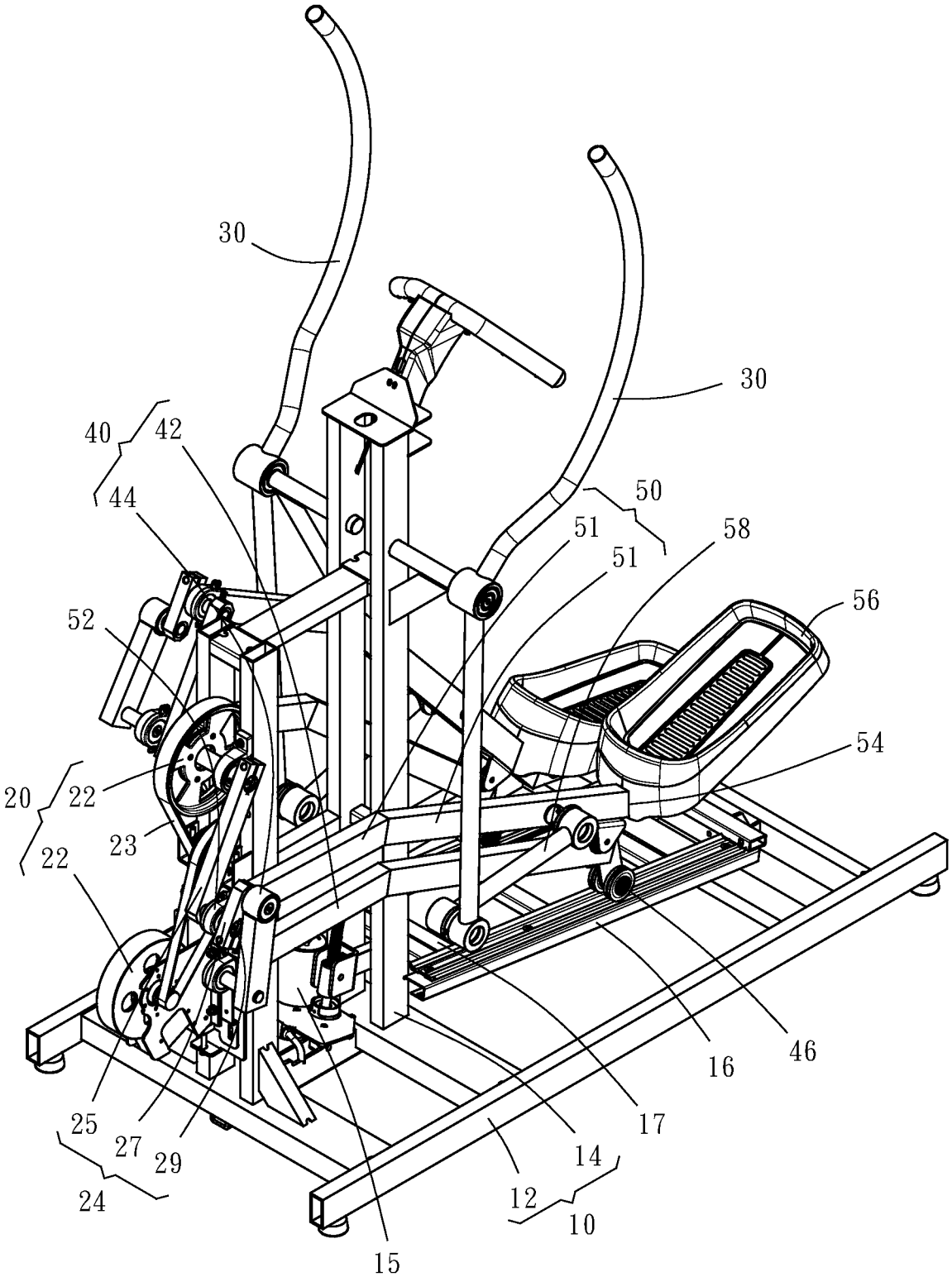
FIG. 1 is a perspective view of a preferred embodiment of the present invention.
Figure 2:
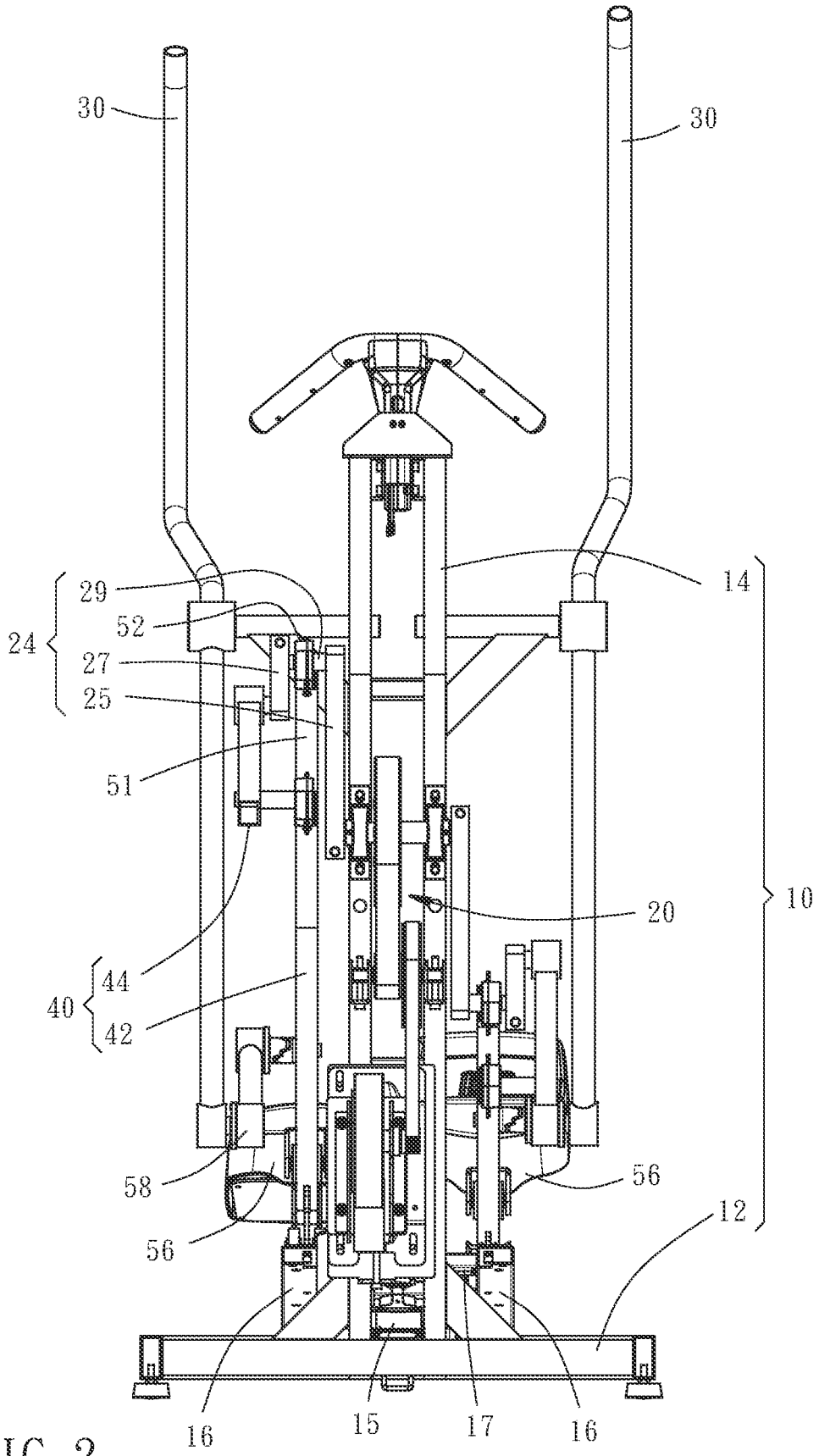
FIG. 2 is a front view of a preferred embodiment of the present invention.
Figure 3:
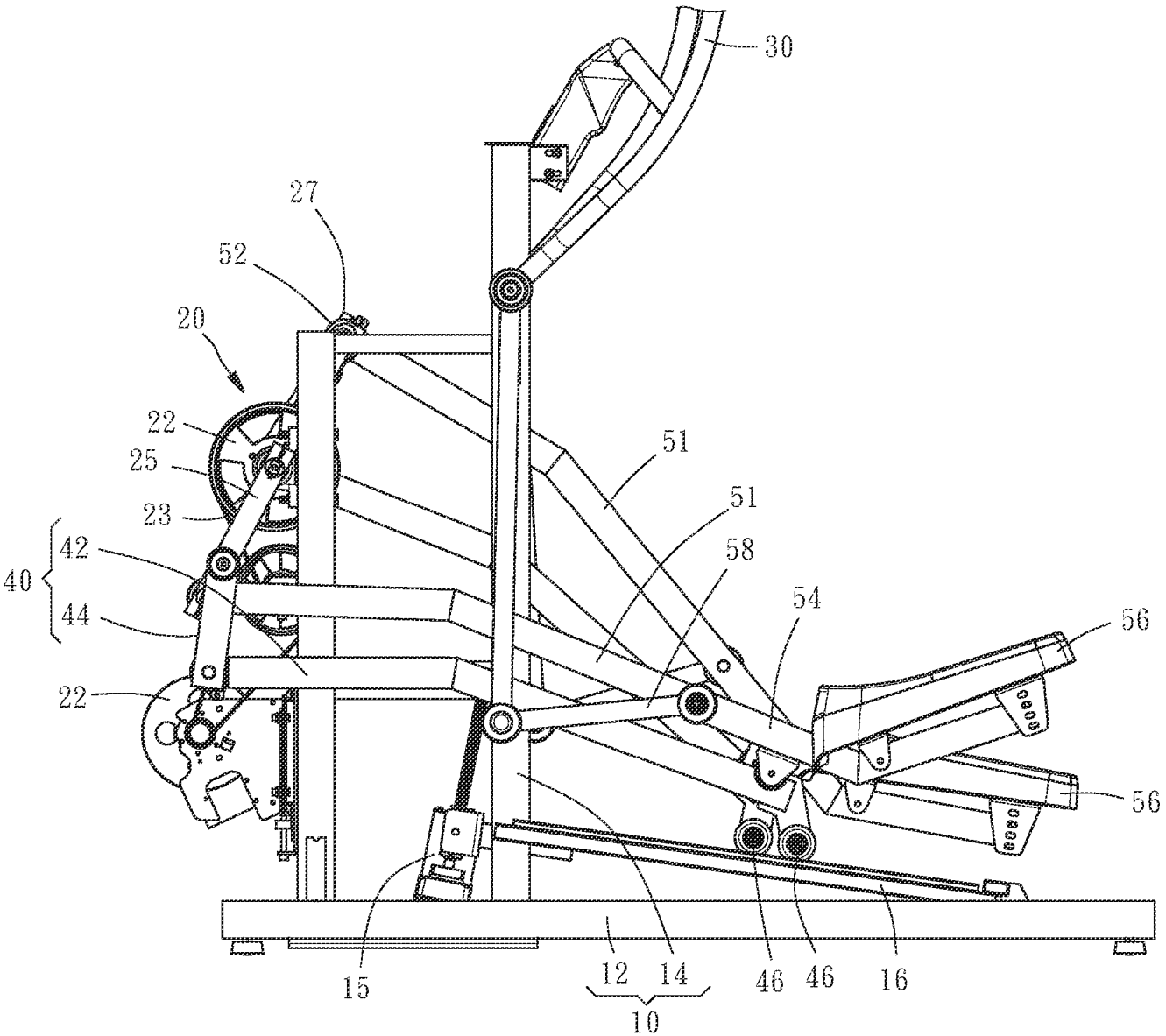
FIG. 3 is a side view of a preferred embodiment of the present invention.

As shown in FIG. 1 to FIG. 3, a linkage mechanism with an elliptical motion trajectory of the present invention, comprising a main body 10, a flywheel assembly 20, two handles 30, two driving linkage assemblies 40 and two pedals 50. The main body 10 includes a base 12 and a vertical column 14 arranged on the base 12. The base 12 includes a driving motor 15 installed thereon and two guiding tracks 16 arranged at two sides of the vertical column 14 respectively. The rear sides of the two guiding tracks 16 are pivotally attached onto the base 12, and the front sides of the two guiding tracks 16 are jointly provided with an attachment rod 17. The attachment rod 17 can be driven by the driving motor 15 in order to allow the two guiding tracks 16 to change a lifting angle relative to the base 12. By using the guiding tracks 16 with different lifting angles, the motion effect of different level of inclinations can be generated.

In a preferred embodiment of the present invention, the flywheel assembly 20 comprises a plurality of flywheel disks 22 of different weights and a transmission belt 23 arranged to surround the flywheel disks 22 as an example for illustration. The cooperative combination of the flywheels disks 22 and the transmission belt 23 is able to obtain a relatively greater balance between the speed ratio of the elliptical motion and the weight of the flywheel. The flywheel assembly 20 is installed on the front side of the vertical column 14 of the main body 10, and the flywheel assembly 20 includes two cranks 24. In this preferred embodiment, the crank 24 comprises a first crank member 25 and a second crank member 27. A spacing rod 29 is installed between the first crank member 25 and the second crank member 27.

The two handles 30 are pivotally attached onto the two sides of the vertical column 14 of the main body 10 respectively. The top end of each handle 30 can be provided to allow the exercising person to grab thereon. The bottom end of each handle 30 extends in a direction toward the base 12.

The two driving linkage assemblies 40 include a guiding rod 42 and a first linkage rod 44. The two driving linkage assemblies 40 are arranged at two sides of the vertical column 14 respectively. The first linkage rod 44 is pivotally attached between one end of each one of the guiding rods 42 and the second crank member 27 of the crank 24. A guiding wheel 46 is installed on another end of each one of the guiding rods 42 and is rollably arranged on each one of the guiding tracks 16.

The two pedals 50 respectively include a front end 52 pivotally attached onto each one of the cranks 24. In this preferred embodiment, each one of the front ends 52 is pivotally attached onto the spacing rod 29 of each one of the first crank member 25 as an example for illustration. Each one of the pedals 50 includes a rear end 54 pivotally attached onto each one of the guiding rods 42 at a location adjacent to each one of the guiding wheels 46. Each one of the pedals 50 is able to move forward and backward together with the guiding rod 42 and along each one of the guiding tracks 16. When the rear end 54 of each one of the pedals 50 is installed with a stepping portion 56 for the foot of the exercising person to place thereon, the two feet of the exercising person can then use the aforementioned linkage mechanism to perform the motion of elliptical trajectory. A second linkage rod 58 is pivotally attached between the body portion of each one of the pedals 50 and a bottom end of each one of the handles 30 in order to drive each one of the handles 30 to swing simultaneously during the movement of each one of the pedals 50. It shall be noted that in this preferred embodiment, the guiding rods 42 or the pedals 50 can selectively comprise supporting racks 51 forming a predefined angle with each other in order to allow the guiding rods 42 or the pedals 50 to have a stroke design of greater versatility and flexibility.

According to the aforementioned assembly and description, when the exercising person is standing on the two stepping portions 56 and holding the top ends of the two handles 30, he or she can step onto the two pedals 50 with both feet in order to allow the pedals 50 to move forward and backward together with the guiding rods 42 and along the guiding tracks 16. In addition, the pedals 50 also push the handles 30 to swing forward and backward via the second linkage rods 58. Furthermore, the guiding rods 42 and the pedals 50 also drive the cranks 24 of the flywheel assembly 20 in order to allow the flywheel assembly 20 to generate rotational inertia, thereby further allowing the pedals 50 and the handles 30 to guide the exercising person to perform full-body workout and exercise.

Since the inertia of the flywheel assembly 20 is transmitted by the driving linkage assemblies 40 to the pedals 50 and the handles 30, the exercising person is able to feel that the force feedback is of a relatively greater comfort, thereby further reducing non-smooth turning occurred in the elliptical motion. In addition, the exercising person is not required to exert an overly great stepping force to drive the entire linkage mechanism. The stepping portions 56 of the pedals 50 can be more stable due to the stepping force effect under the action of the driving linkage assemblies 40. Consequently, the device is able to satisfy the training requirements, to comply with the ergonomics and to reduce sports injuries as well as to enhance the effect of exercise and work out. Moreover, the overall size of the present invention is relatively compact such that it is able to satisfy diverse use demands.

What is claimed is:

1. A linkage mechanism with an elliptical motion trajectory, comprising:

a main body having two guiding tracks with a changeable lifting angle;

a flywheel assembly installed on a front side of the main body and having two cranks;

two handles pivotally attached onto the front side of the main body corresponding to each other;

two driving linkage assemblies with each one of the driving linkage assemblies having a guiding rod, a first linkage rod pivotally attached between one end of each one of the guiding rods and each one of the cranks, a guiding wheel installed on another end of each one of the guiding rods and rollably arranged on each one of the guiding tracks; and two pedals with each one of the pedals having a front end pivotally attached onto each one of the cranks; each one of the pedals having a stepping portion installed on each one of the guiding rods at a location adjacent to each one of the guiding wheels; a second linkage rod pivotally attached between each one of the pedals and a bottom end of each one of the handles; each one of the pedals configured to move together with each one of the guiding rods and along each one of the guiding tracks, and configured to drive the flywheel assembly and each one of the handles to move forward and backward.

2. The linkage mechanism with an elliptical motion trajectory according to claim 1, wherein each one of the cranks comprises a first crank member and a second crank member, a spacing rod installed between the first crank member and the second crank member; the front end of each one of the pedals is pivotally attached onto each one of the spacing rods.

3. The linkage mechanism with an elliptical motion trajectory according to claim 2, wherein each one of the first linkage rods is pivotally attached between one end of each one of the guiding rods and the second crank member.

4. The linkage mechanism with an elliptical motion trajectory according to claim 1, wherein the flywheel assembly comprises at least two flywheel disks of different weights and a transmission belt arranged to surround between the at least two flywheel disks.

5. The linkage mechanism with an elliptical motion trajectory according to claim 1, wherein each one of the pedals or each one of the guiding rods comprises two supporting racks forming a predefined angle with each other.

6. The linkage mechanism with an elliptical motion trajectory according to claim 1, wherein the main body includes a driving motor, and the two guiding tracks are driven by the driving motor to change the lifting angle relative to the main body.

* * * * *